US006854198B2

(12) United States Patent
Brooks

(10) Patent No.: US 6,854,198 B2
(45) Date of Patent: Feb. 15, 2005

(54) FOOTWEAR

(75) Inventor: Jeffrey S. Brooks, St. Louis County, MO (US)

(73) Assignee: Jeffrey S. Brooks, Inc., Creve Coeur, MO (US)

( * ) Notice: Subject to any disclaimer, the term of this patent is extended or adjusted under 35 U.S.C. 154(b) by 0 days.

(21) Appl. No.: 09/855,890

(22) Filed: May 15, 2001

(65) Prior Publication Data

US 2003/0033733 A1 Feb. 20, 2003

Related U.S. Application Data

(63) Continuation of application No. 09/379,764, filed on Aug. 24, 1999, now abandoned, which is a continuation-in-part of application No. 09/092,279, filed on Jun. 5, 1998, now Pat. No. 5,964,046, which is a continuation of application No. 08/861,579, filed on May 22, 1997, now Pat. No. 5,787,610, which is a continuation-in-part of application No. 08/654,726, filed on May 29, 1996, now abandoned.

(51) Int. Cl.[7] ..... A43B 13/18; A43B 13/14

(52) U.S. Cl. ..... 36/28; 36/169; 36/173; 36/180; 36/31; 36/174

(58) Field of Search ..... 36/28, 29, 103, 36/102, 166, 189, 173, 174, 175, 176, 178, 180, 181, 182, 148, 167, 31, 30 R, 32 R, 171, 76 R

(56) References Cited

U.S. PATENT DOCUMENTS

| | | | |
|---|---|---|---|
| 1,055,768 | A | 3/1913 | Levee et al. |
| 1,137,092 | A | 4/1915 | Sharp |
| 1,210,066 | A | 12/1916 | Hara |

(List continued on next page.)

FOREIGN PATENT DOCUMENTS

| | | |
|---|---|---|
| DE | 875466 | 3/1953 |
| DE | K22803 | 7/1957 |
| EP | 0 427 556 A2 | 5/1991 |

(List continued on next page.)

OTHER PUBLICATIONS

Packaging for Sorbothane Full–Sole Insert (1981).
Packaging for Sorbothane Sport Sole Insert (1983).
Advertisement for Sorbothane, date unknown.

(List continued on next page.)

*Primary Examiner*—Ted Kavanaugh
(74) *Attorney, Agent, or Firm*—Senniger Powers

(57) ABSTRACT

Footwear comprising a sole. The sole has a heel section for supporting a heel of the foot. The heel section has medial and lateral regions. At least a portion of the lateral region has a first compressive resilience for attenuating the shock of impact to the wearer during running and walking. Further, the sole has an arch section forward of the heel section for supporting an arch of the foot. The arch section also has medial and lateral regions. At least a portion of the lateral region of the arch section has the first compressive resilience and at least a portion of the medial region of the arch section has a second compressive resilience harder than the first compressive resilience for providing firm support for the foot during running and walking. In addition, the sole has a forefoot section forward of the arch section for supporting a ball of the foot including first, second, third, fourth and fifth metatarsal heads and associated metatarsal necks, proximal phalanges and metatarsal phalangeal joints. The forefoot section has a first region for supporting the first, second, third, fourth and fifth metatarsal heads, associated phalanges and metatarsal phalangeal joints, and the metatarsal neck associated with the fifth metatarsal head and a second region for supporting at least one of the metatarsal necks associated with the second and third metatarsal heads. The first region of the forefoot section has the first compressive resilience and the second region of the forefoot section has the second compressive resilience.

17 Claims, 9 Drawing Sheets

U.S. PATENT DOCUMENTS

| | | | | | |
|---|---|---|---|---|---|
| 1,387,952 | A | | 8/1921 | Steinbrecher | |
| 1,544,625 | A | | 7/1925 | Austin | |
| 1,557,312 | A | | 10/1925 | Lelyveld | |
| 1,828,086 | A | | 10/1931 | Tweedie | |
| 1,992,081 | A | | 2/1935 | Madinger | |
| 2,008,207 | A | | 7/1935 | Greenberg | |
| 2,029,409 | A | | 2/1936 | Brand | |
| 2,034,463 | A | | 3/1936 | Dvlinsky | |
| 2,046,732 | A | | 7/1936 | Fein | |
| 2,081,474 | A | | 5/1937 | Burns | |
| 2,097,759 | A | | 11/1937 | Ehrlich | |
| 2,119,807 | A | | 6/1938 | Farley | |
| 2,255,100 | A | | 9/1941 | Brady | |
| 2,346,279 | A | | 4/1944 | Stritter | |
| 2,379,000 | A | | 6/1945 | Gould | |
| 2,413,534 | A | | 12/1946 | Watson | |
| 2,460,493 | A | | 2/1949 | Diamant | |
| 2,505,032 | A | | 4/1950 | De Voos | |
| 2,658,288 | A | | 11/1953 | Scholl | |
| 2,707,340 | A | * | 5/1955 | Scala | 36/19.5 |
| 2,814,133 | A | | 11/1957 | Herbst | |
| 2,821,032 | A | | 1/1958 | Helfet | |
| 2,828,555 | A | | 4/1958 | Ledos | |
| 2,863,231 | A | | 12/1958 | Jones | |
| 3,068,872 | A | | 12/1962 | Brody | |
| 3,099,267 | A | | 7/1963 | Cherniak | |
| 3,187,069 | A | | 6/1965 | Pincus et al. | |
| 3,233,348 | A | | 2/1966 | Gilkerson | |
| 3,309,797 | A | | 3/1967 | Poitras | |
| 3,333,353 | A | | 8/1967 | Garcia | |
| 3,416,245 | A | | 12/1968 | Ferreira | |
| 3,449,844 | A | | 6/1969 | Spence | |
| 3,530,489 | A | | 9/1970 | Appleton | |
| 3,638,336 | A | | 2/1972 | Silverman | |
| 3,643,353 | A | | 2/1972 | Weight | |
| 3,730,169 | A | | 5/1973 | Fiber | |
| 3,781,231 | A | | 12/1973 | Janssen et al. | |
| 3,842,519 | A | | 10/1974 | Lapidus | |
| 3,847,720 | A | | 11/1974 | Laberinti | |
| 3,935,044 | A | | 1/1976 | Daly | |
| 4,003,146 | A | | 1/1977 | Meier et al. | |
| 4,054,706 | A | | 10/1977 | Shapiro | |
| 4,055,699 | A | | 10/1977 | Hsiung | |
| D246,551 | S | | 12/1977 | Hansjosten et al. | |
| 4,084,333 | A | | 4/1978 | Del Vecchio | |
| 4,101,704 | A | | 7/1978 | Hiles | |
| 4,137,654 | A | | 2/1979 | Hlavac | |
| 4,168,585 | A | | 9/1979 | Gleichner | |
| 4,187,621 | A | | 2/1980 | Cohen | |
| 4,188,736 | A | | 2/1980 | Keller | |
| 4,235,026 | A | | 11/1980 | Plagenhoef | |
| 4,268,980 | A | | 5/1981 | Gudas | |
| 4,272,899 | A | | 6/1981 | Brooks | |
| 4,285,144 | A | | 8/1981 | Power | |
| 4,292,263 | A | | 9/1981 | Hanrahan et al. | |
| 4,296,053 | A | | 10/1981 | Doerer et al. | |
| 4,302,892 | A | | 12/1981 | Adamik | |
| 4,307,521 | A | | 12/1981 | Inohara et al. | |
| 4,316,335 | A | | 2/1982 | Giese et al. | |
| 4,345,387 | A | | 8/1982 | Daswick | |
| 4,346,205 | A | | 8/1982 | Hiles | |
| 4,346,525 | A | | 8/1982 | Larsen et al. | |
| 4,364,189 | A | | 12/1982 | Bates | |
| 4,372,059 | A | | 2/1983 | Ambrose | |
| 4,378,642 | A | | 4/1983 | Light et al. | |
| 4,398,357 | A | | 8/1983 | Batra | |
| 4,408,402 | A | | 10/1983 | Looney | |
| 4,418,483 | A | | 12/1983 | Fujita et al. | |
| 4,435,910 | A | | 3/1984 | Marc | |
| 4,455,340 | A | | 6/1984 | Okina | |
| 4,490,928 | A | | 1/1985 | Kawashima | |
| 4,506,462 | A | | 3/1985 | Cavanagh | |
| 4,510,700 | A | | 4/1985 | Brown | |
| 4,510,702 | A | | 4/1985 | Ehrlich, Jr. | |
| 4,513,518 | A | | 4/1985 | Jalbert et al. | |
| 4,515,851 | A | | 5/1985 | Johnson | |
| 4,517,981 | A | | 5/1985 | Santopietro et al. | |
| 4,519,147 | A | * | 5/1985 | Jones, Jr. | 36/19.5 |
| 4,527,345 | A | | 7/1985 | Lopez Lopez | |
| 4,541,184 | A | | 9/1985 | Leighton | |
| 4,541,186 | A | | 9/1985 | Mulvihill | |
| 4,557,060 | A | | 12/1985 | Kawashima | |
| 4,564,966 | A | | 1/1986 | Chen | |
| 4,581,187 | A | | 4/1986 | Sullivan et al. | |
| 4,586,273 | A | | 5/1986 | Chapnick | |
| 4,608,988 | A | | 9/1986 | Dananberg | |
| 4,615,126 | A | | 10/1986 | Mathews | |
| 4,619,053 | A | | 10/1986 | Schumacher | |
| 4,627,177 | A | | 12/1986 | Meyers | |
| 4,627,178 | A | | 12/1986 | Sullivan et al. | |
| 4,627,179 | A | | 12/1986 | McElroy | |
| 4,633,598 | A | | 1/1987 | Moronaga et al. | |
| 4,633,877 | A | | 1/1987 | Pendergast | |
| 4,642,912 | A | | 2/1987 | Wildman et al. | |
| 4,651,445 | A | | 3/1987 | Hannibal | |
| 4,674,204 | A | | 6/1987 | Sullivan et al. | |
| 4,677,766 | A | | 7/1987 | Gudas | |
| 4,680,877 | A | | 7/1987 | Fink | |
| 4,694,591 | A | | 9/1987 | Banich et al. | |
| 4,697,361 | A | * | 10/1987 | Ganter et al. | 36/28 |
| 4,702,255 | A | | 10/1987 | Schenkl | |
| 4,739,765 | A | | 4/1988 | Sydor et al. | |
| 4,754,561 | A | | 7/1988 | Dufour | |
| 4,757,620 | A | | 7/1988 | Tiitola | |
| 4,769,926 | A | | 9/1988 | Meyers | |
| 4,777,739 | A | | 10/1988 | Hiles | |
| 4,782,605 | A | | 11/1988 | Chapnick | |
| 4,798,010 | A | | 1/1989 | Sugiyama | |
| 4,808,469 | A | | 2/1989 | Hiles | |
| 4,823,483 | A | | 4/1989 | Chapnick | |
| 4,841,647 | A | | 6/1989 | Turucz | |
| D302,764 | S | | 8/1989 | Peoples et al. | |
| 4,854,057 | A | | 8/1989 | Misevich et al. | |
| 4,864,739 | A | | 9/1989 | Maestri | |
| 4,876,805 | A | | 10/1989 | Peoples | |
| 4,879,821 | A | | 11/1989 | Graham et al. | |
| 4,882,856 | A | | 11/1989 | Glancy | |
| 4,908,961 | A | | 3/1990 | Purslow et al. | |
| 4,910,886 | A | | 3/1990 | Sullivan et al. | |
| 4,955,148 | A | | 9/1990 | Padilla | |
| 4,977,691 | A | | 12/1990 | Orchard, 3rd | |
| 5,024,007 | A | | 6/1991 | DuFour | |
| 5,042,174 | A | | 8/1991 | Nichols | |
| 5,077,915 | A | | 1/1992 | Gross | |
| 5,131,173 | A | | 7/1992 | Anderié | |
| 5,146,698 | A | | 9/1992 | Tilles et al. | |
| 5,282,326 | A | | 2/1994 | Schroer, Jr. et al. | |
| 5,319,866 | A | | 6/1994 | Foley et al. | |
| 5,384,973 | A | | 1/1995 | Lyden | |
| 5,448,839 | A | | 9/1995 | Blissett et al. | |
| D362,956 | S | | 10/1995 | Martin et al. | |
| 5,465,507 | A | | 11/1995 | Schumacher et al. | |
| 5,572,805 | A | | 11/1996 | Giese et al. | |
| 5,592,757 | A | | 1/1997 | Jackinsky | |
| 5,611,153 | A | | 3/1997 | Fisher et al. | |
| 5,787,610 | A | * | 8/1998 | Brooks | |
| 5,896,682 | A | * | 4/1999 | Lin | 36/29 |
| 5,964,046 | A | * | 10/1999 | Brooks | |

FOREIGN PATENT DOCUMENTS

| | | | |
|---|---|---|---|
| EP | 0 591 909 A1 | | 4/1994 |
| FR | 1207258 | | 2/1960 |
| FR | 1413280 | | 8/1965 |
| FR | 2015914 | | 8/1969 |
| FR | 2272618 | | 3/1975 |
| FR | 2309169 | | 5/1975 |
| FR | 2427801 | | 6/1978 |
| FR | 2506132 | | 11/1982 |
| GB | 217833 | | 6/1924 |
| GB | 452492 | | 5/1935 |
| GB | 1243575 | | 8/1971 |
| GB | 1564195 | | 4/1980 |
| GB | 2057964 | | 4/1981 |
| GB | 2088776 | | 6/1982 |
| GB | 91/16831 | * | 11/1991 |
| IT | 303241 | | 11/1932 |
| IT | 362452 | | 8/1938 |

OTHER PUBLICATIONS

Forefoot Varus Biomechanical Compendium, The Biomechanical Research and Educational Laboratory, date unknown.

Sporthotics® Insole (photographs marked "A1–A6") made by The Langer Biomechanics Group, Inc., date of first public use unknown.

Sporthotics® Insole (photographs marked "B1–B6") made by The Langer Biomechanics Group, Inc., date of first public use unknown.

Sporthotics® Insole (photographs marked "C1–C6") made by The Langer Biomechanics Group, Inc., date of first public use unknown.

* cited by examiner

FOOTWEAR

CROSS-REFERENCE TO RELATED APPLICATIONS

This is a continuation of application Ser. No. 09/379,764 filed Aug. 24, 1999 now abandoned, which is a continuation-in-part of application Ser. No. 09/092,279 filed Jun. 5, 1998, issued Oct. 12, 1999 as U.S. Pat. No. 5,964,046, which was a continuation of application Ser. No. 08/861,579 filed May 22, 1997, issued Aug. 4, 1998 as U.S. Pat. No. 5,787,610, which was a continuation-in-part of application Ser. No. 08/654,726 filed May 29, 1996, now abandoned, all of which are hereby incorporated by reference.

BACKGROUND OF THE INVENTION

This invention relates generally to footwear representing an improvement on the design described in my U.S. Pat. No. 4,272,899 which is hereby incorporated by reference.

The footwear of the present invention comprises a sole of composite construction, that is, the sole is formed of a first material positioned for attenuating the impact forces applied to the foot and other skeletal structures during standing, walking and running, and a second harder material for firmly supporting the foot.

When walking and running, the lateral (outside) portion of the heel is generally the first part of the foot to strike the ground, with the foot then pivoting on the heel to bring the lateral part of the forefoot into contact with the ground. At this point, the foot is supinated (inclined upwardly from the lateral to the medial side of the foot), but rapidly pronates to a neutral position in which the bottom of the heel and the metatarsal heads of the forefoot are in contact with the ground, and in which the central vertical plane of the heel is ideally generally perpendicular to the ground. During this sequence of movements, various muscles and tendons contract to stabilize the foot in preparation for movement from the neutral position back to a supinated position prior to the propulsive phase of the gait cycle. (The propulsive phase is sometimes referred to as toe-off or push-off.) The arch (i.e., the bone structural alignment) of the foot should be firmly supported when the foot is in the neutral position in order to prevent the ligaments, muscles and tendons from becoming over stressed. During toe-off, it is preferable that the second and third metatarsals be firmly supported, and that the first metatarsal head plantarflex (move downward) relative the second and third metatarsal heads. The toes also should be firmly supported during push-off so that they remain straight and thus stronger due to the pillar effect of the phalanges.

In view of the foregoing, it will be observed that certain parts of the foot are subjected to higher stress during standing, running and walking, and that other parts of the foot require different degrees of support for maximum biomechanical efficiency. Moreover, high impact forces to the foot are transferred to other skeletal structures such as the shins and knees. The present invention takes these considerations into account and provides the appropriate amount of shock attenuation and support to different regions of the foot, thus protecting those parts of the foot which are subjected to high impact forces, and allowing other parts of the foot to function in a way which provides maximum efficiency to prepare the body for stresses placed on it.

Further, the stiffness of the sole, and of the outsole in particular, tends to inhibit flexure of the foot in the area of the metatarsal phalangeal joints. These joints are located between the proximal phalanges (i.e., the rear toe bones) and the metatarsals (i.e., the bones overlying the forward portion of the arch). The stiffness of the sole inhibits dorsiflexion during which the phalanges flex upward relative to the metatarsals. Because the aforementioned stiffness inhibits flexure, the footwear may be uncomfortable, especially during break-in. There is a need, therefore, for footwear which is more flexible, particularly in an area generally corresponding to the metatarsal phalangeal joints of the foot.

SUMMARY OF THE INVENTION

Among the several objects of this invention may be noted the provision of footwear which is tailored to the biomechanical operation of a wearer's foot; the provision of optimizing footwear to one or more of the various needs of a particular wearer and/or task by providing an appropriate amount of support and cushioning applied to regions of the particular wearer's foot; the provision of such footwear which is more comfortable and which reduces the risk of overstress and injury to the foot; the provision of such footwear which readily accommodates the natural flexure of the foot for ease of movement; and the provision of the present invention which may be incorporated in the soles of footwear such as shoes, boots and sandals, or in insoles for placement inside shoes and the like.

In general, footwear of the present invention comprises a sole. The sole has a heel section for supporting a heel of the foot. The heel section has medial and lateral regions. At least a portion of the lateral region has a first compressive resilience for attenuating the shock of impact to the wearer during running and walking. Further, the sole has an arch section forward of the heel section for supporting an arch of the foot. The arch section also has medial and lateral regions. At least a portion of the lateral region of the arch section has the first compressive resilience, and at least a portion of the medial region of the arch section has a second compressive resilience harder than the first compressive resilience for providing firm support for the foot during running and walking. In addition, the sole has a forefoot section forward of the arch section for supporting a ball of the foot including first, second, third, fourth and fifth metatarsal heads and associated metatarsal necks, proximal phalanges and metatarsal phalangeal joints. The forefoot section has a first region for supporting the first, second, third, fourth and fifth metatarsal heads, associated phalanges and metatarsal phalangeal joints, and the metatarsal neck associated with the fifth metatarsal head and a second region for supporting at least one of the metatarsal necks associated with the second and third metatarsal heads. The first region of the forefoot section has the first compressive resilience and the second region of the forefoot section has the second compressive resilience.

In another aspect, the invention includes a sole for footwear comprising a heel section, an arch section, and a forefoot section. The sole has a first selected effective compression resistance in at least part of the lateral region of the heel section, at least part of the lateral region of the arch section, and the first region of the forefoot section and a second selected effective compression resistance greater than the first compression resistance in at least part of the medial region of the arch section and the second region of the forefoot section. In addition, the sole includes a zone of weakness extending generally transversely with respect to the sole along a curve extending through locations generally corresponding to the five metatarsal phalangeal joints for providing greater flexibility for easier articulation of the metatarsals relative to the phalanges of the foot.

Other objects and features of this invention will be in part apparent and in part pointed out hereinafter.

BRIEF DESCRIPTION OF THE DRAWINGS

Corresponding parts are designated by corresponding reference characters throughout the several views of the drawings.

DETAILED DESCRIPTION OF THE PREFERRED EMBODIMENTS

Figure 1:
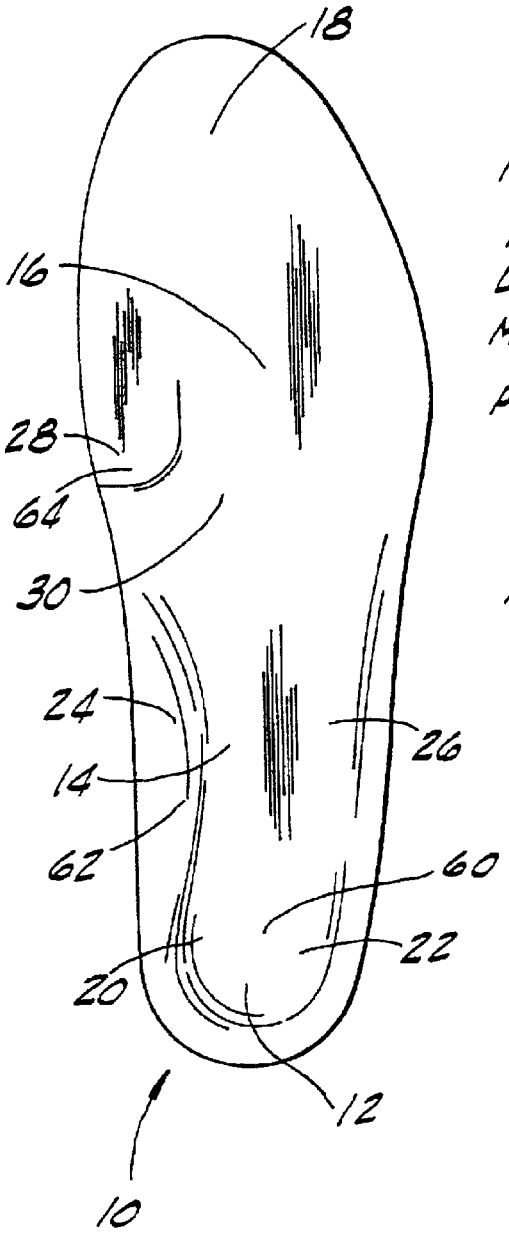
FIG. 1 is a top view of a sole of the present invention for the right foot.
Figure 2:
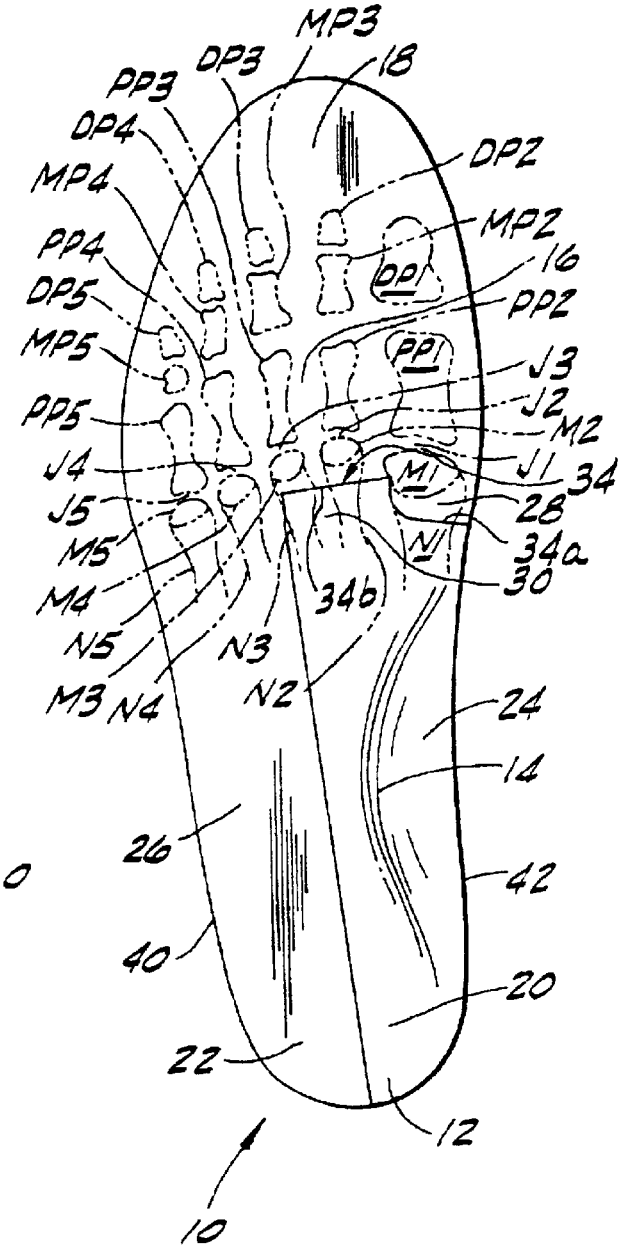
FIG. 2 is an underside view of the sole of FIG. 1 showing its composite construction.

Referring to FIGS. 1 and 2 of the drawings, footwear of the present invention comprising a sole is designated in its entirety by the reference numeral 10. The sole 10 is shown as having four sections, a heel section 12, an arch section 14, a forefoot section 16, and a toe section 18, corresponding to parts of a wearer's foot. In use, the heel section 12 underlies the heel of the wearer's foot and includes medial and lateral regions designated 20, 22, respectively, corresponding to the inner and outer sides of the foot, respectively. Likewise, the arch section 14, which is forward of the heel section 12, underlies the arch of the wearer's foot and also includes medial and lateral regions 24, 26, respectively. The forefoot section 16 is forward of the arch section 14 and underlies the ball of the foot, the latter of which includes the first, second, third, fourth and fifth metatarsal heads indicated in phantom at M1–M5 in FIG. 2. The ball of the foot also includes first, second, third, fourth and fifth metatarsal necks (N1–N5) associated with the metatarsal heads, first, second, third, fourth and fifth proximal phalanges (PP1–PP5) forward of the respective metatarsal heads, and associated metatarsal phalangeal joints (J1–J5) between the metatarsal heads and proximal phalanges. The forefoot section 16 is divided into first and second regions designated 28 and 30, respectively. The first region 28 is adapted to underlie all five metatarsal heads M1–M5, the fourth and fifth metatarsal necks N4 and N5, the proximal phalanges PP1–PP5, and the metatarsal phalangeal joints J1–J5. The second region 30 underlies and supports the second and third metatarsal necks N2, N3. Regions 28 and 30 are defined by a boundary line generally designated 34 having a forward medial (inner) segment 34*a* and a lateral (outer) segment 34*b*. As illustrated in FIG. 2, the medial (inner) segment 34*a* of boundary line 34 is offset rearwardly with respect to lateral segment 34*b* of the line to accommodate the first metatarsal head. Segment 34*a* passes directly beneath the neck of the first metatarsal head, and segment 34*b* passes directly beneath the necks of the second and third metatarsal necks. The toe section 18 of the sole is spaced forward of the forefoot section 16 and underlies at least the middle phalanges MP2–MP5 and distal phalanges DP1–DP5 of the toes of the wearer's foot.

In accordance with the present invention, the sole 10 is formed so that a resilient material is located in the lateral region of the heel section, the lateral region of the arch section, the first region of the forefoot section and the toe section. A harder material is located in the medial region of the heel section, the medial region of the arch section and the second region of the forefoot section. This configuration is best illustrated in FIG. 2, which shows the softer material formed as a first, preferably unitary body 40 having a shape generally resembling the numeral "7", and the harder material formed as a second, preferably unitary body 42 attached to the first body directly to the right of and below the first body 40.

Figure 3:
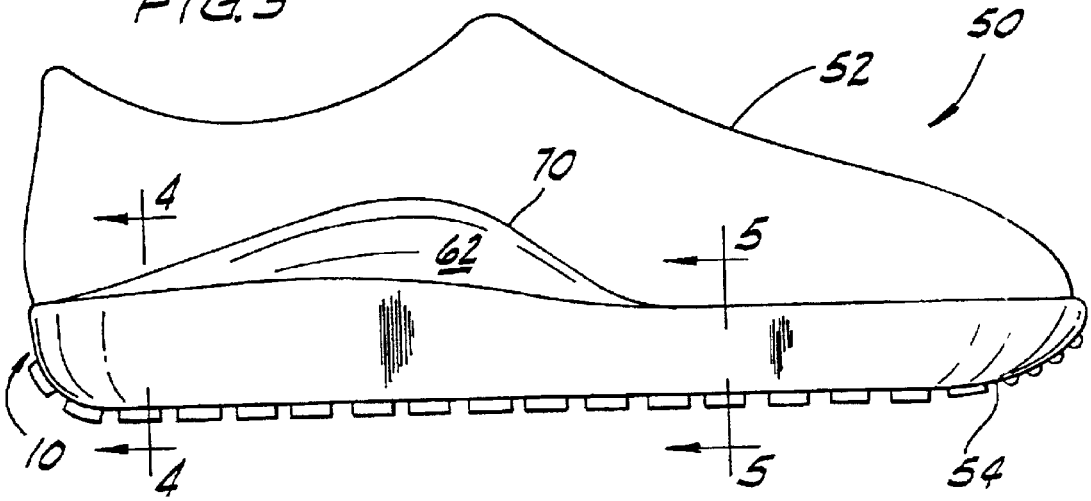
FIG. 3 is a right side (lateral) elevation of a shoe having a sole which incorporates the present invention.
Figure 4:
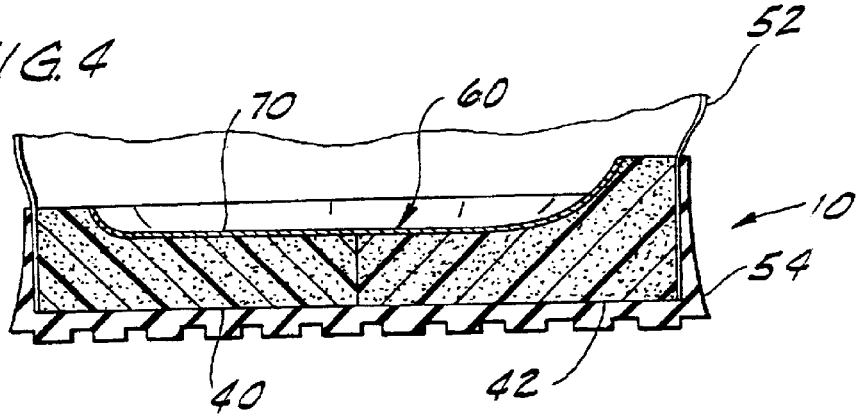
FIG. 4 is a cross section taken in the plane of line 4—4 of FIG. 3.
Figure 5:
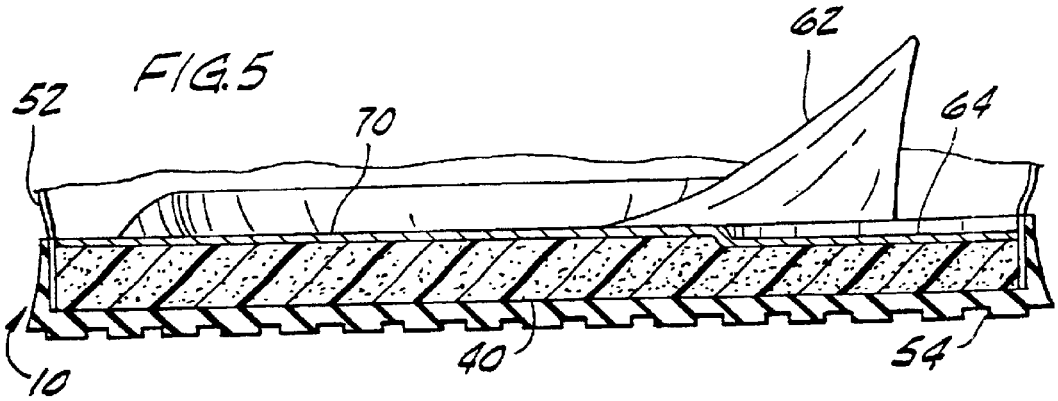
FIG. 5 is a cross section taken in the plane of line 5—5 of FIG. 3.

FIGS. 3–5 show the sole 10 incorporated in a shoe, indicated generally at 50, having an upper 52 secured to the sole in a suitable fashion. The sole 10 comprises the two bodies 40, 42 (FIG. 4) located in side-by-side relation. The body 40 of softer material preferably has a Type C (commonly referred to as "Shore C scale") durometer hardness measured in accordance with American Society of Testing and Materials (ASTM) standard D 2440-97 of less than about 70 and more preferably a hardness in a range of about 40–60. Depending upon the particular activity for which the footwear is intended, the hardness may be different. For instance, if the footwear is intended for walking, the body 40 of softer material may have a Type C durometer hardness (ASTM D 2240-97) of about 45, whereas if the footwear is intended of running, the body 40 may have a hardness of about 60. In short, the body 40 should be sufficiently "soft" to provide shock attenuation, but sufficiently firm to provide stability to the foot. The body 42 of harder material preferably has a Type C durometer hardness (ASTM D 2240-97) of 50–85, and preferably greater than about 60. For footwear (e.g. work boots) subjected to heavy loading, the body 42 preferably has a hardness of about 75. As will be understood by those skilled in the art, the harder material is less compressible than the softer material although both materials are generally resilient when compressed under the weight of a wearer.

The two bodies 40, 42 or sections of the sole can be bonded to one another in any suitable fashion, as by heat fusion, adhesive, or by a chemical or curing process. The two bodies can be formed of any suitable sole material, such as polyurethane, TPR, PVC, EVA or other materials well known to those of ordinary skill in the art of footwear. Also, the two bodies 40 and 42 can be made of a single material (e.g., PVC or EVA) having different durometer hardnesses, or of different materials having different durometer hardnesses. In addition, the two bodies may be made of different colored materials to enhance the aesthetic characteristics of the insole and to highlight the use of multiple materials for marketability.

The composite sole described above formed by the two bodies 40, 42 may be used in lieu of a midsole of a conventional shoe, in which case the bodies may be permanently bonded or otherwise integrally attached to a wear resistant outsole 54, or the bodies may be used in lieu of a conventional one-piece cup sole. The thicknesses and contours of bodies 40 and 42 may be individually designed to compensate for the various characteristics of a particular wearer or group of wearers. For example, the upper surfaces of the two bodies 40, 42 may be appropriately contoured for the foot of the person wearing the footwear. Further, the upper surfaces of the bodies 40, 42 may be formed with a U-shaped heel seat 60 (FIGS. 1 and 4), an arch support 62 (FIGS. 1, 3 and 5) and a bunion cradle 64 (FIGS. 1 and 5). Depending upon the physical attributes of the intended wearer, the thicknesses of these formations may be varied to accommodate his or her needs as described in my U.S. Pat. No. 4,272,899.

As illustrated in FIG. 4, a layer of material 70, e.g., elastomeric polymer cloth, covers the entire upper surface of bodies 40 and 42 to form a sock liner and improve the appearance of the sole 10. Further, the liner 70 prevents the sole 10 from adhering to the wearer's foot or clothing. Indicia such as trademarks may printed on the upper surface of the liner. In addition, the liner 70 may be made of an odor and/or moisture absorbing material as is known in the art. Optionally, the liner 70 may also be impregnated with an antibacterial and/or antimicrobial agent.

Thus configured, the sole 10 protects those parts of the foot which are subjected to high impact forces, and supports other parts of the foot to function in a way which provides maximum efficiency and prepares the body for stresses placed on it, thereby reducing the risk of injury. The softer material of the first body 40 compresses relatively easily when loaded. However, the harder material of the second body 42 does not compress easily when loaded. Therefore, the areas of the sole 10 incorporating the softer material of the first body 40 deflect to absorb impact forces, and the areas of the sole incorporating the harder material of the second body 42 resist movement to more firmly support the foot.

As each step is taken, some sections of the foot require more cushioning and others require firmer support. The lateral portion of the heel is generally the first part of the foot to strike the ground. The softer body 40 in the lateral region 22 of the heel section 12 of the sole 10 cushions the initial impact. After the initial impact, the foot pivots downward on the heel, and the lateral portions of the arch and forefoot impact the ground. The softer material in the lateral region 26 of the arch section 14 and in the first region 28 of the forefoot section 16 absorbs the shock of this secondary impact. After the secondary impact, the foot pronates to a neutral position wherein the bottom of the heel and the metatarsal heads M1–M5 of the forefoot contact the ground, and the central vertical plane of the heel is generally perpendicular to the ground. The harder body 42 in the medial region 24 of the arch section 14 firmly supports the osseous alignment of the foot when in the neutral position thereby relieving stress in the ligaments, muscles and tendons which maintain the foot in this position. During toe-off, the harder material of the forefoot section 16 supports the second and third metatarsal necks N2, N3, but the softer material used in the first region 28 of the forefoot section permits the first metatarsal neck N1 and head M1 to plantarflex relative to the second and third metatarsal heads M2, M3. This motion places the foot in an appropriate biomechanical position during the propulsive phase of the gait cycle. This motion also permits the sesamoid apparatus to function properly during mid-stance and toe-off. The softer material under the metatarsal heads M1–M5 also serves to dissipate weight from the mid-stance through the propulsive phases of the gait cycle.

It will be observed from the foregoing that the material properties of the various sole regions appropriately cushion and support various parts of the user's foot. Moreover, the shapes of the first and second bodies 40, 42 enhance the movement and support of the foot. For instance, the bunion cradle 64 of the preferred embodiment permits the first metatarsal head M1 to plantarflex relative to the second and third metatarsal heads M2, M3 during toe-off. Likewise, the arch support 62 and the heel seat 60 support and cradle the osseous structure of the foot to maintain the appropriate neutral position after pronation and to prevent the ligaments, tendons and muscles of the user's feet and legs from being over stressed.

Figure 6:
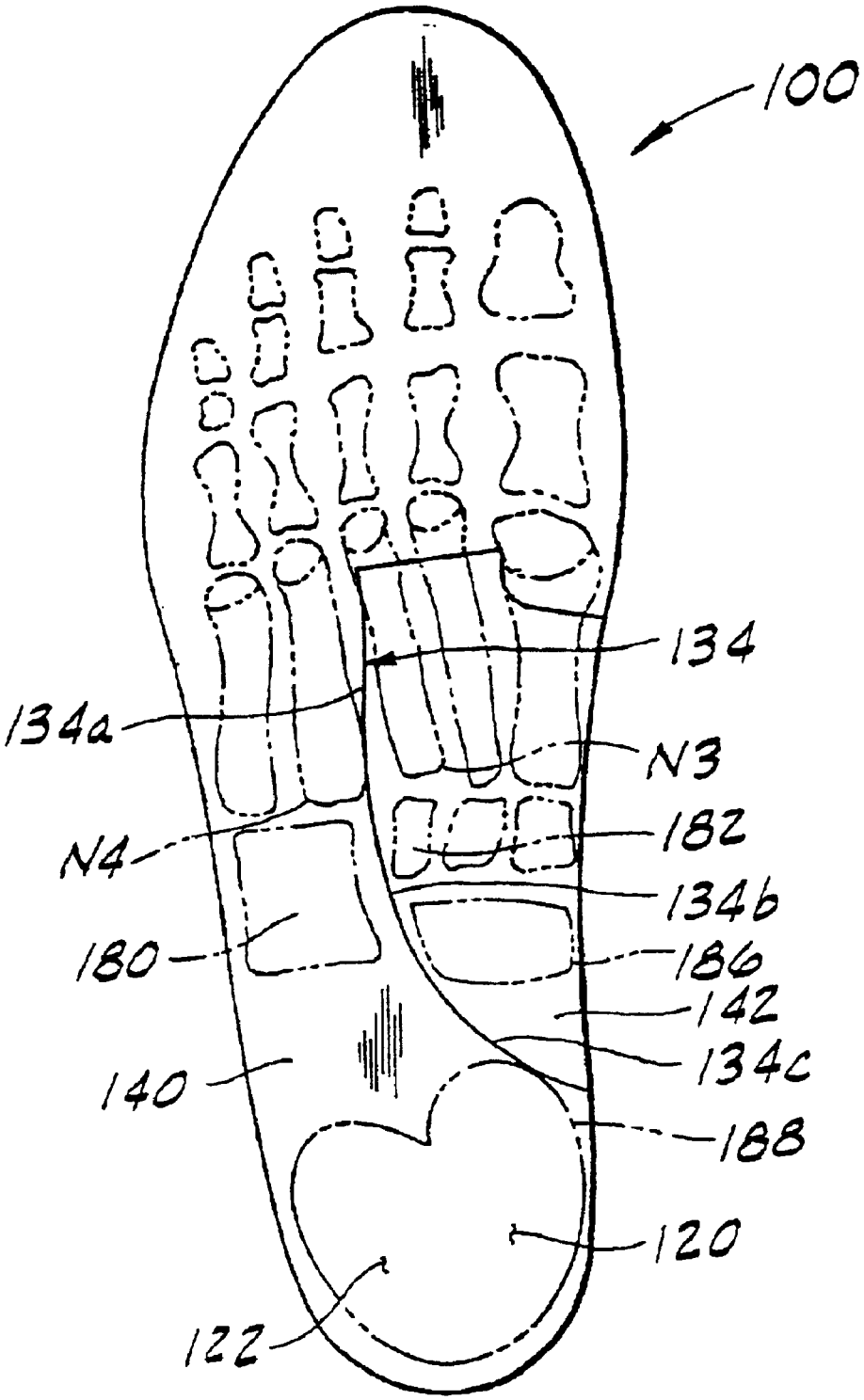
FIG. 6 is a view similar to FIG. 2 showing an alternative embodiment of the present invention.

FIG. 6 illustrates a second embodiment of a sole 100 of the present invention. This version is identical to the sole 10 described above except that the medial and lateral regions of the heel (designated 120 and 122, respectively) are both formed from the same softer material. In other words, the medial region 120 of the heel is not formed from a harder material as in the first embodiment. As shown in FIG. 6, the longitudinal boundary line 134 separating the body 140 of softer material from the body 142 of harder material has a longitudinal segment 134*a* which extends generally between the third and fourth metatarsal necks N3, N4, a segment 134*b* which extends rearwardly between the cuboid bone 180 and the lateral cuneiform bone 182 of the foot, and a segment 134*c* which curves gradually in a rearward and medial direction to the medial side of sole, passing between the navicular bone 186 and the forward end of the medial tuberosity 188 of the heel. This sole design functions in the same manner as the sole design of the first embodiment, except that it provides cushioning for the entire heel area, not just the lateral region of the heel.

It will be appreciated that the hardnesses presented above may be altered depending upon the intended use of the sole. For example, adult footwear designed for use in situations where the wearer will frequently be carrying a heavy load (e.g., work boots) may require more support than a child's dress shoe. Likewise, footwear made for running may require firmer support in the heel section to absorb the initial shock of each step than would a hiking boot in which more cushion may be required.

In addition, it will be appreciated that the present invention is not limited necessarily to any particular type of footwear and may be equally desirable for use in removable insoles, as well as for use in the soles of shoes, boots and sandals. ("Footwear" as used herein includes all of these items and any other item having or consisting of a sole.) Further, it should be understood that the locations and shapes of the areas of softer and harder material may be altered without departing from the scope of this invention. Likewise, the unique configuration of softer and harder material may be employed at any vertical level of a sole or insole to provide the desired support without departing from the scope of the invention. For example, if the sole or insole is laminated, one or more of the laminae may be configured to have the softer and harder materials in the appropriate areas described above.

Figure 7:
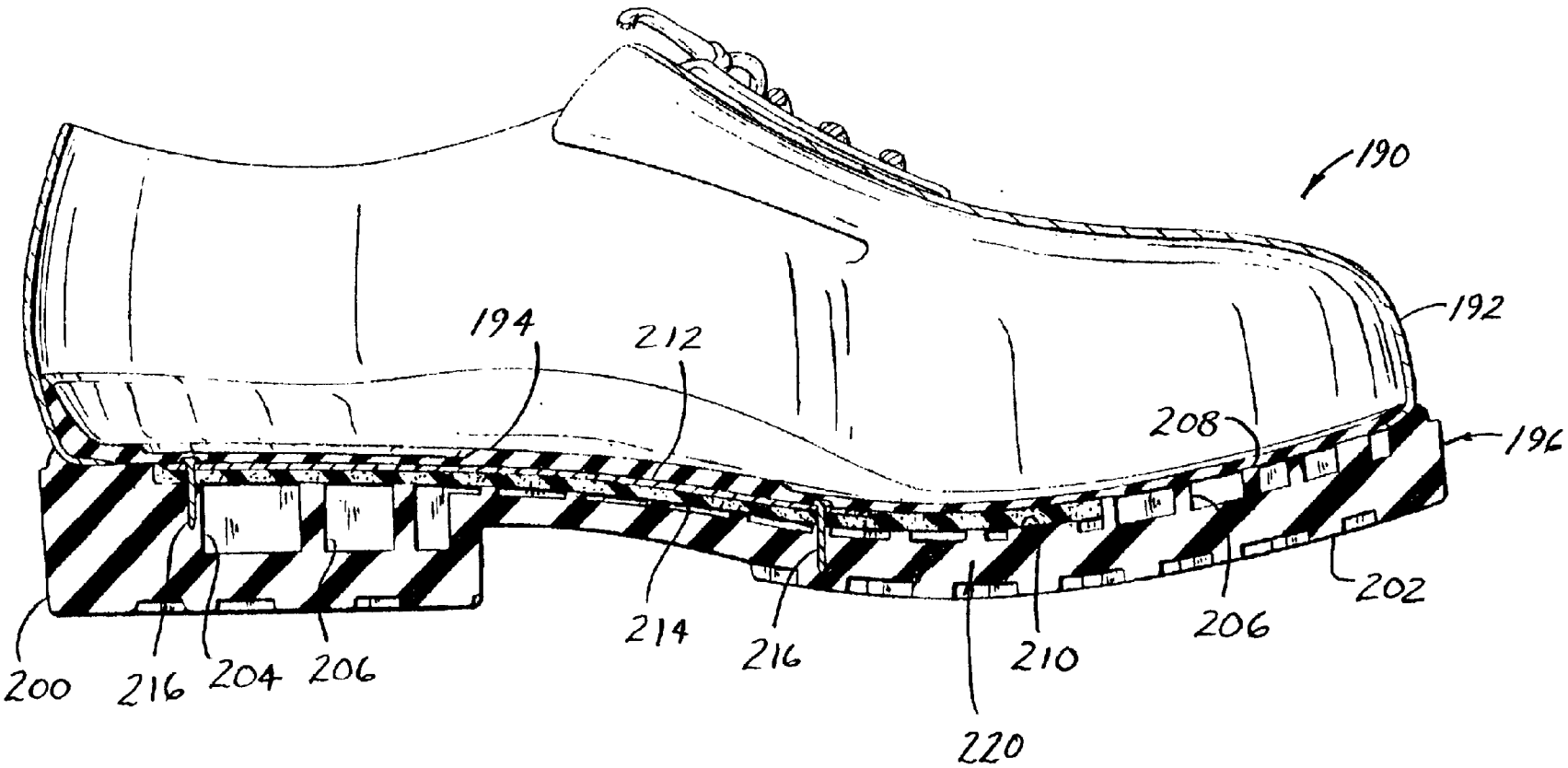
FIG. 7 is a vertical longitudinal cross section of footwear having a sole according to a second alternative embodiment of the present invention.
Figure 8:
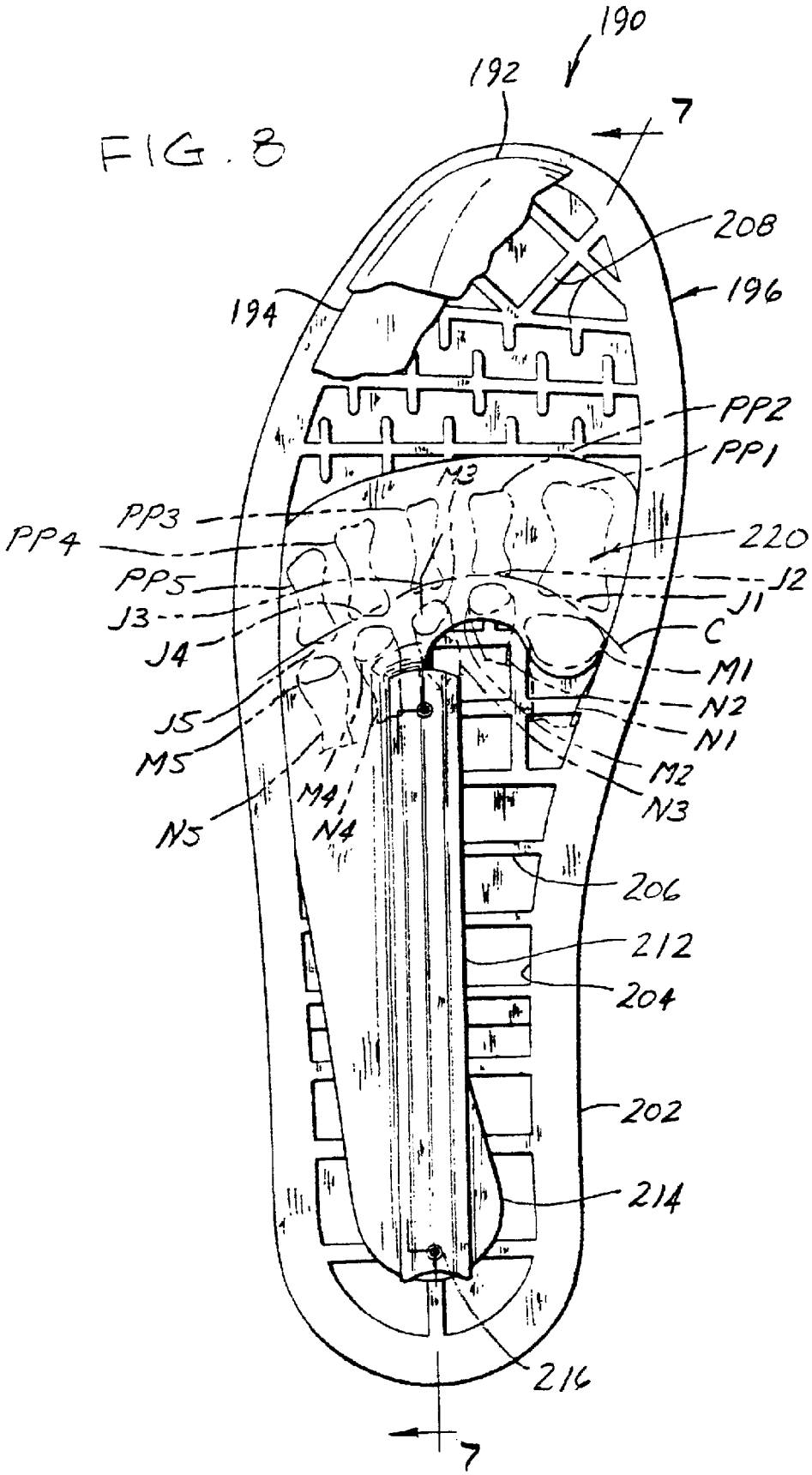
FIG. 8 is a fragmentary top plan of the footwear of the second alternative embodiment showing the construction of the sole.
Figure 9:
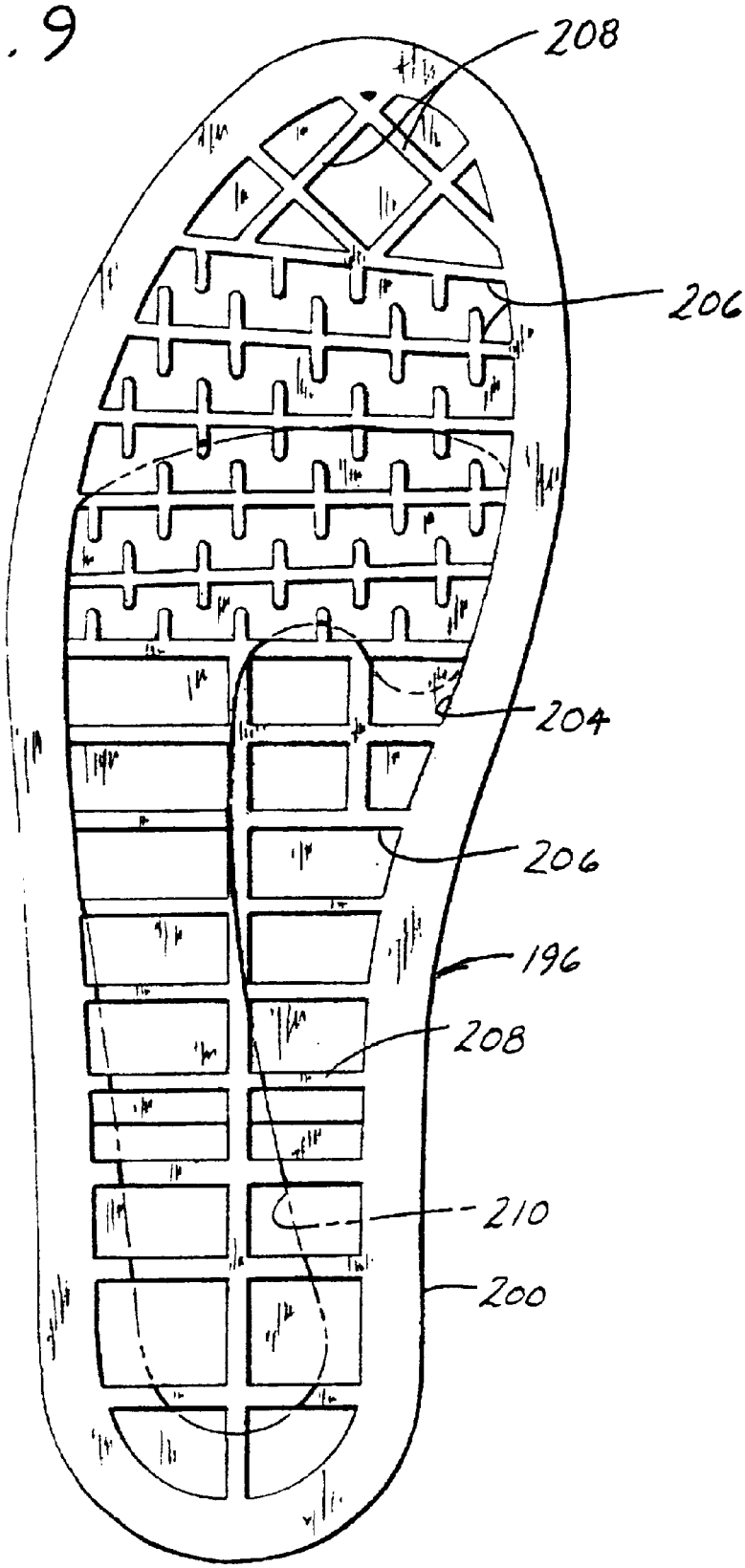
FIG. 9 is a top plan of the an outsole of the footwear of the second alternative embodiment.

FIGS. 7 and 8 illustrate a third embodiment of footwear, generally designated by 190, of the present invention. As illustrated in FIG. 7, the footwear 190 generally comprises a conventional upper 192, a conventional insole 194 and a sole, generally designated by 196. Although the sole 196 may have other constructions without departing from the scope of the present invention, in the most preferred embodiment, the sole 196 comprises a unitary outsole 200 having a treaded bottom 202 (FIG. 7) and a hollow interior 204 filled with ribs 206, the upper ends of which form a discontinuous upper surface or grid 208 which firmly supports the insole 194. As shown in FIG. 9, the ribs 206 in a central portion of the outsole 200 are shorter (and/or alternatively omitted entirely) to form an uninterrupted cavity or open space 210 extending downward into the outsole from the upper surface 208. A conventional metal shank 212 and a soft foam insert 214 are positioned in the cavity 210 as shown in FIG. 7 and the shank is fastened to the outsole 200 with fasteners 216 so the upper faces of the insert and shank are flush with the upper surface 208 of the outsole. Thus, the shank 212 holds the insert 214 in position against the outsole 200. The outsole 200 is made of conventional outsole material which is somewhat incompressible and the foam insert 214 is made of a softer material having less resistance to compression than the outsole material. Such softer materials include the materials described previously with respect to the body 40. Although the shank 212 of the preferred embodiment is positioned on top of the insert 214, it is envisioned that the shank may be positioned within the insert, below the insert or omitted entirely in some outsoles (e.g., wedge outsoles) without departing from the scope of the present invention.

As shown in FIG. 8, the cavity 210 and insert 214 have complementary shapes resembling a numeral seven. Because the insert 214 is softer than the ribs 206, the insert provides less compression resistance than the ribs so it absorbs shock and cushions the corresponding areas of the foot. Further, the portion of the outsole 196 where the insert 214 is not present is harder so it provides greater compression resistance to firmly support the corresponding areas of the foot.

Figure 10:
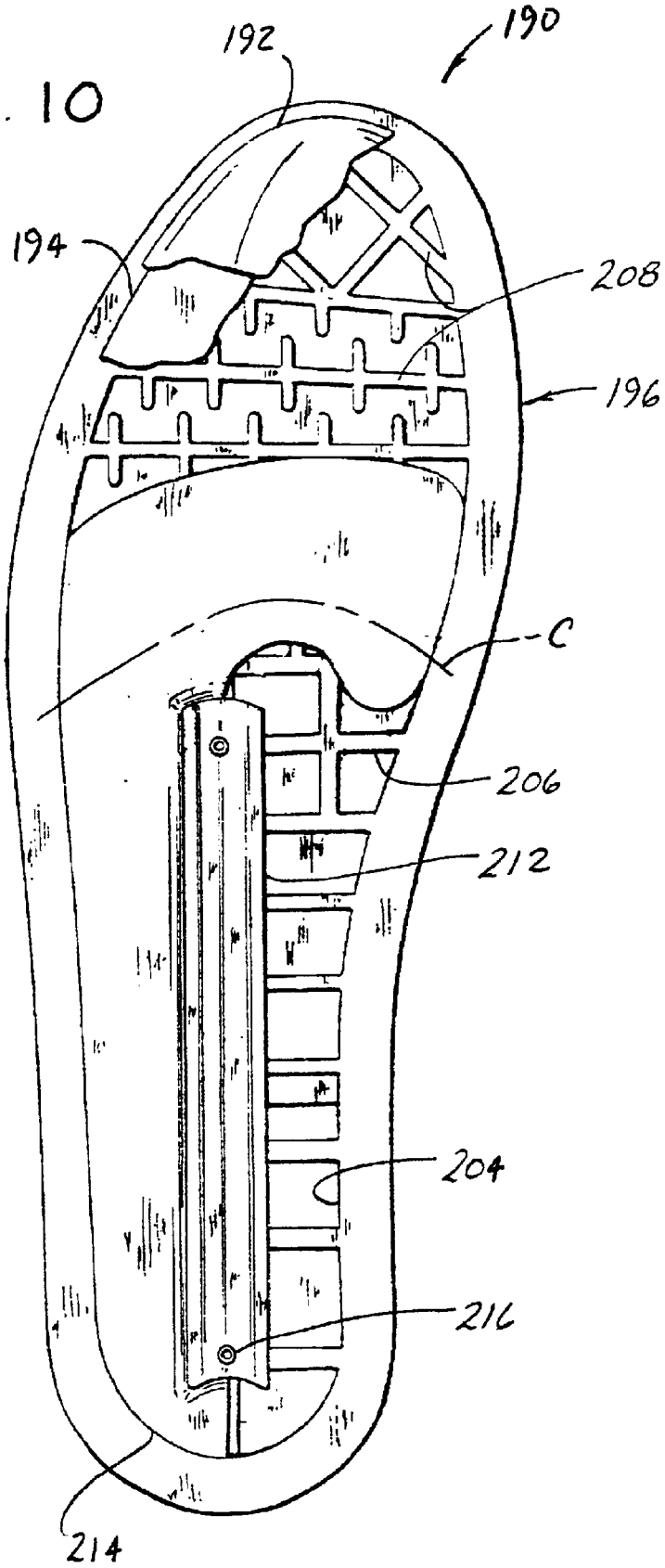
FIG. 10 is a fragmentary top plan of footwear of a third alternative embodiment of the present invention.

FIG. 10 illustrates an alternative embodiment in which the rearward portion of the insert 214 and cavity 210 are shifted laterally to cushion and absorb shock in the lateral regions of the heel section and the arch section of the foot. Other aspects of this embodiment are identical to those of the embodiment shown in FIGS. 8 and 9. Thus, the embodiment shown in FIG. 10 will not be described in further detail.

Figure 11:
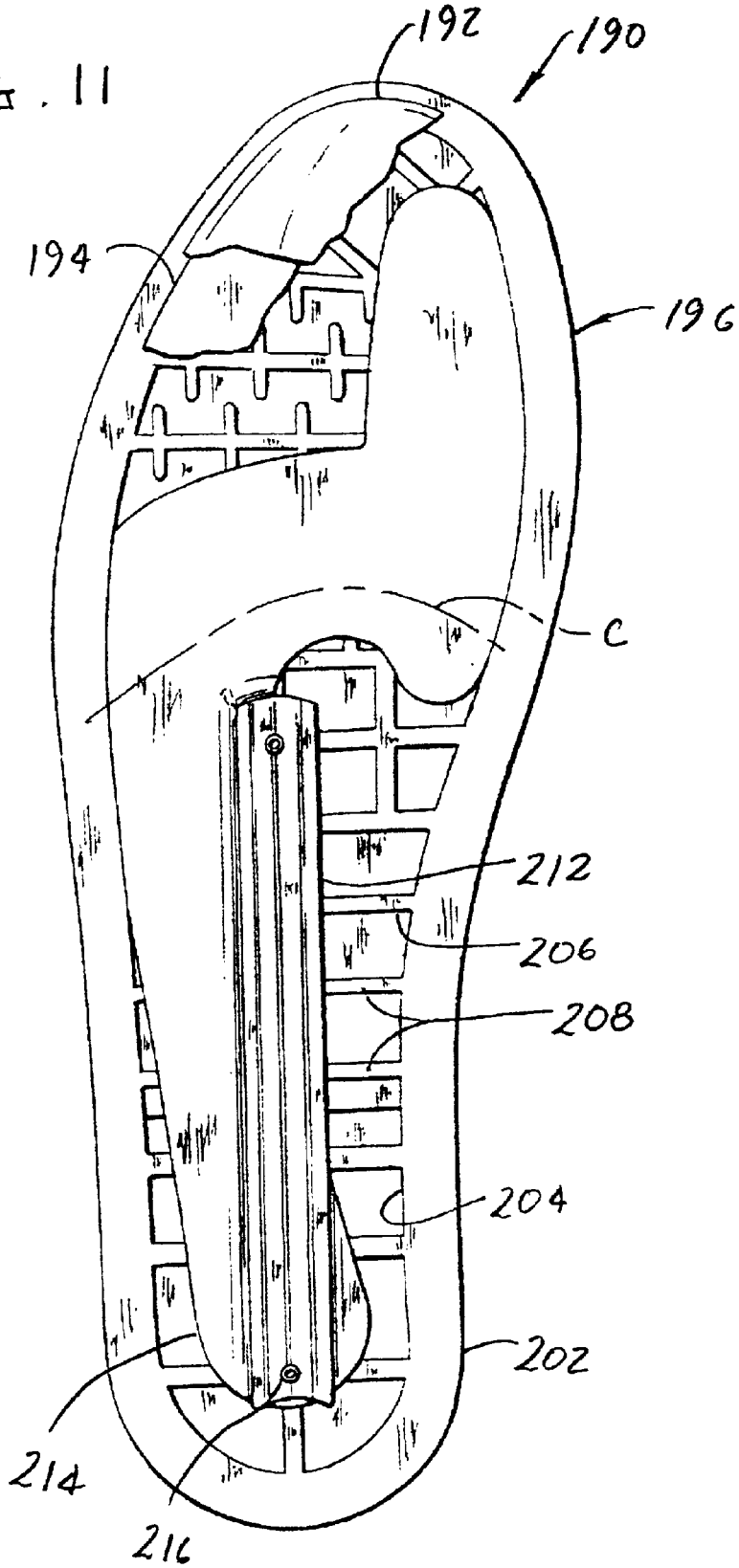
FIG. 11 is a fragmentary top plan of the footwear of the fourth alternative embodiment showing the construction of the sole.
Figure 12:
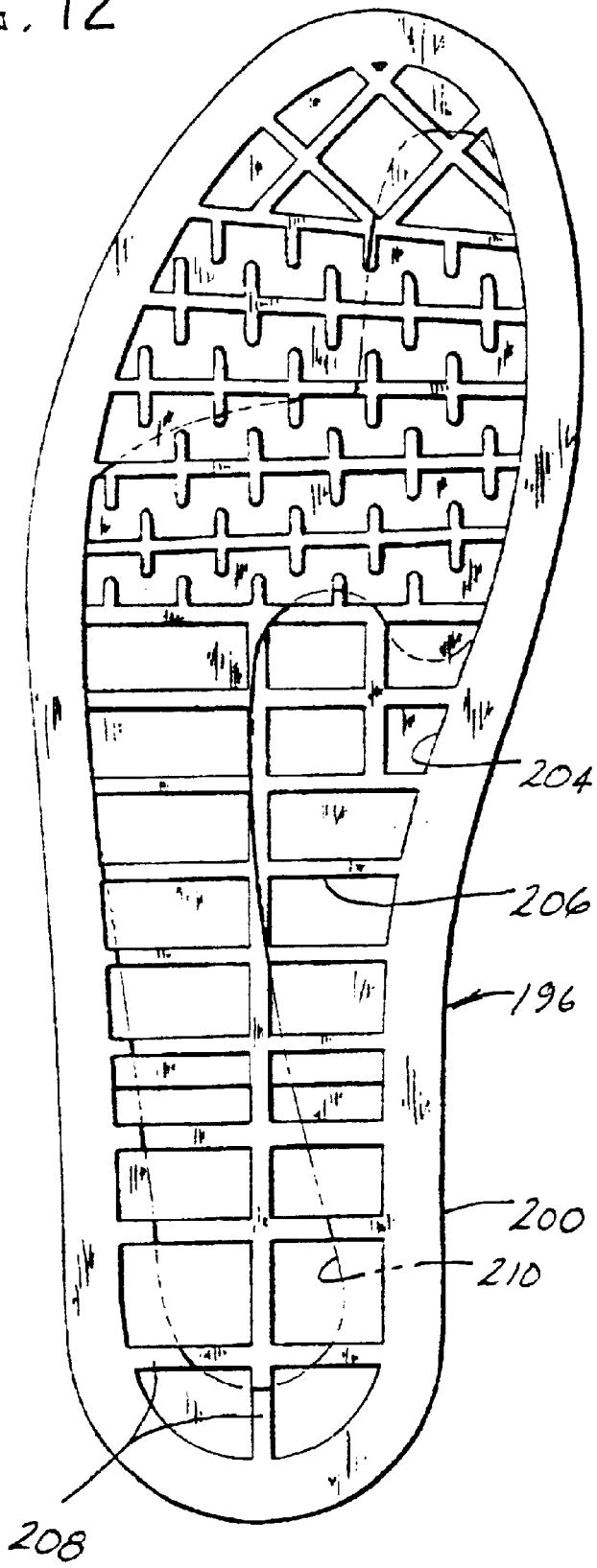
FIG. 12 is a top plan of the an outsole of the footwear of the fourth alternative embodiment.

FIGS. 11 and 12 illustrate yet another embodiment similar to the embodiment shown in FIGS. 8 and 9 except that the insert 214 and cavity 210 extend forward under the first proximal and distal phalanges to cushion the big toe when running and walking. As the other aspects of this embodiment are identical to those of the embodiment shown in FIGS. 8 and 9, this embodiment will not be described in further detail.

Although the shape of the insert 214 and cavity 210 may vary somewhat without departing from the scope of the present invention, preferably the insert and cavity are shaped so parts of the lateral regions of the heel section and the arch section of a foot are supported by the softer insert material to absorb shock and cushion the foot. In the embodiment shown in FIGS. 8 and 9, the insert 214 has a width sufficient to support a region of the arch of the foot extending rearward from the 4th and 5th metatarsal heads M4, M5 and necks N4, N5. Further, the insert 214 preferably underlies the region of the forefoot section supporting the first, second, third, fourth and fifth metatarsal heads M1–M5, the associated phalanges PP1–PP5 and metatarsal phalangeal joints J1–J5, and the metatarsal neck N5 associated with the fifth metatarsal head MS as shown in FIG. 8. The insert 214 and cavity 210 are also preferably shaped so the upper surface 208 of the outsole underlies at least part of the medial region of the arch section and the region of the forefoot section which supports either or both of the metatarsal necks N2, N3 associated with the second and third metatarsal heads M2, M3. Thus, the harder material of the outsole 196 provides firm support to the portions of the insole 194 corresponding to these regions of the foot.

Further, as illustrated in FIG. 8 a portion of the cavity 210 extends almost entirely across the outsole 196 under the metatarsal phalangeal joints J1–J5 making the sole more flexible in this area. This increased flexibility allows the outsole 196 to bend more easily under the metatarsal phalangeal joints J1–J5 thereby creating a zone of weakness, generally designated by 220. The zone 220 extends generally transversely with respect to the sole 196 along a curve C extending through locations generally corresponding to the five metatarsal phalangeal joints of the foot. The sole 196 has greater flexibility in the zone of weakness 220 to permit the metatarsals M1–M5 to bend more easily relative to the phalanges PP1–PP5 of the foot.

In view of the above, it will be seen that the several objects of the invention are achieved and other advantageous results attained.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

While the present invention has been described by reference to a specific embodiment, it should be understood that modifications and variations of the invention may be constructed without departing from the scope of the invention defined in the following claims.

What is claimed is:

1. Footwear comprising:

a sole comprising a unitary outsole of a wear resistant material having a resistance to compression, said outsole having a bottom, an upper surface, a heel section having medial and lateral regions, an arch section having medial and lateral regions, and a forefoot section having a first region for supporting the first, second, third, fourth and fifth metatarsal heads of a foot, associated phalanges and metatarsal phalangeal joints of the foot, and the metatarsal neck associated with the fifth metatarsal head of the foot, and a second region for supporting at least one of the metatarsal necks associated with the second and third metatarsal heads of the foot;

a cavity in the outsole;

an insert in the cavity having a resistance to compression less than the resistance to compression of the outsole;

said insert being sized and shaped to overlie the outsole in at least part of the lateral region of the heel section of the outsole, at least part of the lateral region of the arch section of the outsole, and the first region of the forefoot section for attenuating the shock of impact in these regions during running and walking, and said insert being sized and shaped not to overlie at least part of the medial region of the arch section of the outsole and the second region of the forefoot section of the outsole whereby the outsole provides firmer foot support in these regions during walking and running.

2. Footwear as set forth in claim 1 wherein the insert substantially fills the cavity and has an upper surface substantially flush with the upper surface of the outsole surrounding the cavity.

3. Footwear as set forth in claim 1 further comprising an insole overlying the insert and the upper surface of the outsole.

4. Footwear as set forth in claim 3 wherein the unitary outsole comprises a series of upstanding ribs having upper ends which form said upper surface of the heel, arch and forefoot sections of the outsole and which support said insert and said insole.

5. Footwear as set forth in claim 1 wherein said cavity and insert have substantially the same size and shape.

6. Footwear as set forth in claim 5 wherein said shape resembles a numeral 7.

7. Footwear as set forth in claim 1 wherein said cavity and insert extend over an area of the outsole corresponding to the first distal phalange of the foot but not the second, third, fourth and fifth distal phalanges of the foot.

8. Footwear as set forth in claim 1 further comprising an insole overlying the outsole and the insert, and a rigid shank extending longitudinally of the footwear at a location overying the heel and arch sections of the outsole and underlying the insole.

9. Footwear as set forth in claim 1 wherein said insert is of a foam material having a Type C durometer hardness of less than 70, and wherein said outsole material has a Type C durometer hardness of 50–85.

10. Footwear as set forth in claim 1 wherein said insert is of a foam material having a Type C durometer hardness in the range of about 40–60, and wherein said outsole material has a Type C durometer hardness of about 75.

11. Footwear as set forth in claim 1 wherein said insert has a width sufficient to support a lateral region of the arch of the foot extending rearward from the fourth and fifth metatarsal heads and necks of the foot.

12. Footwear as set forth in claim 1 wherein said outsole having said cavity therein is of one-piece construction.

13. Footwear comprising:

a sole comprising a unitary outsole of a wear resistant material having a resistance to compression, said outsole having a bottom, an upper surface, a heel section having medial and lateral regions, an arch section having medial and lateral regions, and a forefoot section having a first region for supporting the first, second, third, fourth and fifth metatarsal heads of a foot, associated proximal phalanges and metatarsal phalangeal joints of the foot, and the metatarsal neck associated with the fifth metatarsal head of the foot, and a second region for supporting at least one of the metatarsal necks associated with the second and third metatarsal heads of the foot;

a cavity in the upper surface of the outsole;

an insert in the cavity substantially filling the cavity and having an upper surface substantially flush with the upper surface of the outsole surrounding the cavity, said insert having a shape resembling a numeral 7 and having a resistance to compression less than the resistance to compression of the outsole;

said insert being sized and shaped to overlie at least part of the lateral region of the heel section of the outsole, at least part of the lateral region of the arch section of the outsole, and the first region of the forefoot section of the outsole for attenuating the shock of impact in these regions during running and walking, and said insert being sized and shaped not to overlie at least part of the medial region of the arch section of the outsole and the second region of the forefoot section of the outsole whereby the outsole provides firmer support in these regions during running and walking;

said insert comprising a foam material having a Type C durometer hardness of less than 70, and said outsole material having a Type C durometer hardness of 50–85.

14. Footwear as set forth in claim 13 wherein said insert has a width sufficient to support a lateral region of the arch of the foot extending rearward from the fourth and fifth metatarsal heads and necks of the foot.

15. Footwear as set forth in claim 13 wherein said outsole having said cavity therein is of one-piece construction.

16. Footwear comprising:

a sole comprising a unitary outsole of a wear resistant material having a resistance to compression, said outsole having a bottom, an upper surface, a heel section having medial and lateral regions, an arch section having medial and lateral regions, and a forefoot section having a first region for supporting the first, second, third, fourth and fifth metatarsal heads of a foot, associated proximal phalanges and metatarsal phalangeal joints of the foot, and the metatarsal neck associated with the fifth metatarsal head of the foot, and a second region for supporting at least one of the metatarsal necks associated with the second and third metatarsal heads of the foot;

a cavity in the upper surface of the outsole;

a shock-attenuating insert of foam material in the cavity having a shape resembling a numeral 7 and having a resistance to compression less than the resistance to compression of the outsole;

said insert being sized and shaped to overlie at least part of the lateral region of the heel section of the outsole for supporting at least part of a lateral region of the heel of the foot, at least part of the lateral region of the arch section of the outsole for supporting a lateral region of the arch of the foot extending rearward from the fourth and fifth metatarsal heads and necks of the foot, and the first region of the forefoot section of the outsole, and said insert being sized and shaped not to overlie at least part of the medial region of the arch section of the outsole and the second region of the forefoot section of the outsole whereby the outsole provides firmer support in these regions during running and walking.

17. Footwear as set forth in claim 16 wherein said outsole having said cavity therein is of one-piece construction.

* * * * *